US010078994B2

(12) United States Patent
Kim et al.

(10) Patent No.: US 10,078,994 B2
(45) Date of Patent: Sep. 18, 2018

(54) VOLTAGE GENERATING CIRCUIT, METHOD OF OPERATING THE SAME, AND DISPLAY DEVICE

(71) Applicant: SAMSUNG DISPLAY CO., LTD., Yongin-si, Gyeonggi-do (KR)

(72) Inventors: Jundal Kim, Asan-si (KR); Du-hyun Kim, Cheonan-si (KR); Jaiho Kim, Hwaseong-si (KR); Boram Shin, Asan-si (KR); Hyunkyu Jo, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 48 days.

(21) Appl. No.: 15/197,698

(22) Filed: Jun. 29, 2016

(65) Prior Publication Data

US 2017/0169788 A1 Jun. 15, 2017

(30) Foreign Application Priority Data

Dec. 9, 2015 (KR) ..... 10-2015-0175279

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2300/0809* (2013.01)

(58) Field of Classification Search
CPC ... G09G 3/3696; G09G 3/3677; G09G 3/3688
USPC ..... 345/212
See application file for complete search history.

(56) References Cited

U.S. PATENT DOCUMENTS

2005/0088329 A1* 4/2005 Tsuchi ..... G09G 3/3688 341/144
2014/0146429 A1 5/2014 Lee et al.

FOREIGN PATENT DOCUMENTS

KR 10-2008-0075729 A 8/2008
KR 10-2013-0107916 A 10/2013
KR 10-2013-0108021 A 10/2013
KR 10-2015-0080360 A 7/2015

* cited by examiner

*Primary Examiner* — Fred Tzeng
(74) *Attorney, Agent, or Firm* — Lewis Roca Rothgerber Christie LLP

(57) ABSTRACT

A voltage generating circuit includes: a first output voltage generator to receive an input voltage, to output a first output voltage, to compare the input voltage with a first reference voltage, and to stop the output of the first output voltage according to the comparison; and a second output voltage generator to receive the input voltage, to output a second output voltage, to compare the input voltage with a second reference voltage, and to stop the output of the second output voltage according to the comparison. The first output voltage generator is to compare first reference voltage data with second reference voltage data, and to change the first reference voltage according to the comparison. The second output voltage generator is to compare the first reference voltage data with the second reference voltage data, and to change the second reference voltage according to the comparison.

19 Claims, 9 Drawing Sheets

VOLTAGE GENERATING CIRCUIT, METHOD OF OPERATING THE SAME, AND DISPLAY DEVICE

CROSS-REFERENCE TO RELATED APPLICATION

This patent application claims priority to and the benefit of Korean Patent Application No. 10-2015-0175279, filed on Dec. 9, 2015, in the Korean Intellectual Property Office (KIPO), the entire content of which is hereby incorporated by reference.

BACKGROUND

1. Field

One or more aspects of example embodiments of the present disclosure relate to a voltage generating circuit for setting a reference voltage, a method of operating the same, and a display device including the same.

2. Description of the Related Art

In general, a display device includes a display panel for displaying an image, a drive circuit for driving the display panel, and a voltage generating circuit. The display panel includes a plurality of gate lines, a plurality of data lines, and a plurality of pixels. Each of the plurality of pixels includes a thin film transistor, a liquid crystal capacitor, and a storage capacitor. The drive circuit includes a data driver for outputting data driving signals to the data lines, a gate driver for outputting gate driving signals to drive the gate lines, and a timing controller for controlling the data driver and the gate driver.

After applying a gate on voltage to a gate electrode of a thin film transistor connected to a gate line, such a display device may display an image by applying a data voltage corresponding to a display image to a source electrode of the thin film transistor.

The voltage generating circuit generates voltages used for operations of the display panel and the drive circuit. The voltages generated from the voltage generating circuit are maintained or substantially maintained at a stable voltage level, thereby maintaining the quality of an image displayed on a display panel.

The above information disclosed in this Background section is for enhancement of understanding of the background of the inventive concept, and therefore, it may contain information that does not constitute prior art.

SUMMARY

One or more aspects of example embodiments of the present disclosure provide a voltage generating circuit for outputting a stable voltage by detecting a voltage level of an input voltage.

One or more aspects of example embodiments of the present disclosure provide a method of operating a voltage generating circuit for outputting a stable voltage by detecting a voltage level of an input voltage.

One or more aspects of example embodiments of the present disclosure provide a display device including a voltage generating circuit for outputting a stable voltage by detecting a voltage level of an input voltage.

According to an example embodiment of the inventive concept, a voltage generating circuit includes: a first output voltage generator configured to receive an input voltage, to output a first output voltage, to compare the input voltage with a first reference voltage, and to stop the output of the first output voltage according to the comparison; and a second output voltage generator configured to receive the input voltage, to output a second output voltage, to compare the input voltage with a second reference voltage, and to stop the output of the second output voltage according to the comparison, wherein: the first output voltage generator is configured to provide first reference voltage data corresponding to the first reference voltage to the second output voltage generator, and the second output voltage generator is configured to provide second reference voltage data corresponding to the second reference voltage to the first output voltage generator; the first output voltage generator is configured to compare the first reference voltage data with the second reference voltage data, and to change the first reference voltage according to the comparison; and the second output voltage generator is configured to compare the first reference voltage data with the second reference voltage data, and to change the second reference voltage according to the comparison.

In an embodiment, the first output voltage generator may be configured to transmit the first reference voltage data and receive the second reference voltage data through a serial interface bus, and the second output voltage generator may be configured to transmit the second reference voltage data and receive the first reference voltage data through the serial interface bus.

In an embodiment, the first output voltage generator may include: a first output voltage converter configured to receive the input voltage and to output the first output voltage; a first controller configured to compare the input voltage with the first reference voltage, and to stop the output of the first output voltage according to the comparison; and a first comparator configured to compare the first reference voltage data with the second reference voltage data, and to change the first reference voltage according to the comparison.

In an embodiment, the first comparator may include: a first analog to digital converter configured to convert the first reference voltage to the first reference voltage data; and a first reference voltage setting circuit configured to compare the first reference voltage data with second reference voltage data from the second output voltage generator, and to set the first reference voltage data according to the comparison.

In an embodiment, the first output voltage generator may further include a first memory configured to store the first reference voltage data.

In an embodiment, the first controller may include: a reference voltage generator configured to generate the first reference voltage based on the first reference voltage data; and a comparator configured to compare the input voltage with the first reference voltage, and to output a low voltage control signal according to the comparison.

In an embodiment, the first reference voltage to be stored in the first memory may include a first rising reference voltage and a first falling reference voltage.

In an embodiment, the reference voltage generator may be configured to generate the first reference voltage corresponding to one of the first rising reference voltage and the first falling reference voltage according to a signal level of the low voltage control signal.

In an embodiment, the second output voltage generator may include: a second output voltage converter configured to receive the input voltage and to output the second output voltage; a second controller configured to compare the input voltage with the second reference voltage, and to stop the output of the second output voltage according to the comparison; and a second comparator configured to compare the second reference voltage data with the first reference voltage data, and to change the second reference voltage according to the comparison.

In an embodiment, the second comparator may include: a second analog to digital converter configured to convert the second reference voltage to the second reference voltage data; and a second reference voltage setting circuit configured to compare the second reference voltage data with the first reference voltage data from the first output voltage generator, and to set the second reference voltage data according to the comparison.

In an embodiment, the first reference voltage setting circuit may be configured to transmit the first reference voltage data and receive the second reference voltage data through a serial interface bus, and the second reference voltage setting circuit may be configured to transmit the second reference voltage data and receive the first reference voltage data through the serial interface bus.

In an embodiment, each of the first output voltage generator and the second output voltage generator may be configured with an integrated circuit.

According to an example embodiment of the inventive concept, a method of operating a voltage generating circuit including a first output voltage generator for outputting a first output voltage and a second output voltage generator for outputting a second output voltage, includes: comparing, by the first output voltage generator, an input voltage with a first reference voltage when the input voltage is supplied; comparing, by the second output voltage generator, the input voltage with a second reference voltage when the input voltage is supplied; comparing, by the first output voltage generator, first reference voltage data corresponding to the first reference voltage with second reference voltage data corresponding to the second reference voltage when the input voltage has a higher level than that of the first reference voltage; changing the first reference voltage of the first output voltage generator according to the comparison of the first reference voltage data with the second reference voltage data; comparing, by the second output voltage generator, the first reference voltage data with the second reference voltage data when the input voltage has a higher level than that of the second reference voltage; and changing the second reference voltage of the second output voltage generator according to the comparison of the first reference voltage data with the second reference voltage data.

In an embodiment, the first reference voltage may include a first rising reference voltage, and the second reference voltage may include a second rising reference voltage.

In an embodiment, the first reference voltage may further include a first falling reference voltage, and the second reference voltage may further include a second rising reference voltage.

In an embodiment, the method may further include: comparing, by the first output voltage generator, the first falling reference voltage with the second falling reference voltage; changing the first falling reference voltage of the first output voltage generator according to the comparison of the first falling reference voltage with the second falling reference voltage; comparing, by the second output voltage generator, the first falling reference voltage with the second falling reference voltage; and changing the second falling reference voltage of the second output voltage generator according to the comparison of the first falling reference voltage with the second falling reference voltage.

According to an example embodiment of the inventive concept, a display device includes: a display panel; a drive circuit configured to display an image on the display panel; and a voltage generating circuit configured to generate a first output voltage and a second output voltage utilized for at least one operation of the display panel and/or the drive circuit, the voltage generating circuit including: a first output voltage generator configured to receive an input voltage, to output a first output voltage, to compare the input voltage with a first reference voltage, and to stop the output of the first output voltage according to a the comparison; and a second output voltage generator configured to receive the input voltage, to output a second output voltage, to compare the input voltage with a second reference voltage, and to stop the output of the second output voltage according to the comparison, wherein: the first output voltage generator is configured to provide first reference voltage data corresponding to the first reference voltage to the second output voltage generator, and the second output voltage generator is configured to provide second reference voltage data corresponding to the second reference voltage to the first output voltage generator; the first output voltage generator is configured to compare the first reference voltage data with the second reference voltage data, and to change the first reference voltage according to the comparison; and the second output voltage generator is configured to compare the first reference voltage data with the second reference voltage data, and to change the second reference voltage according to the comparison.

In an embodiment, the first output voltage generator may be configured to transmit the first reference voltage data and receive the second reference voltage data through a serial interface bus, and the second output voltage generator may be configured to transmit the second reference voltage data and receive the first reference voltage data through the serial interface bus.

In an embodiment, each of the first output voltage generator and the second output voltage generator may be configured with an integrated circuit.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept, and together with the description, serve to explain aspects and features of the inventive concept. In the drawings.

DETAILED DESCRIPTION

Figure 1:
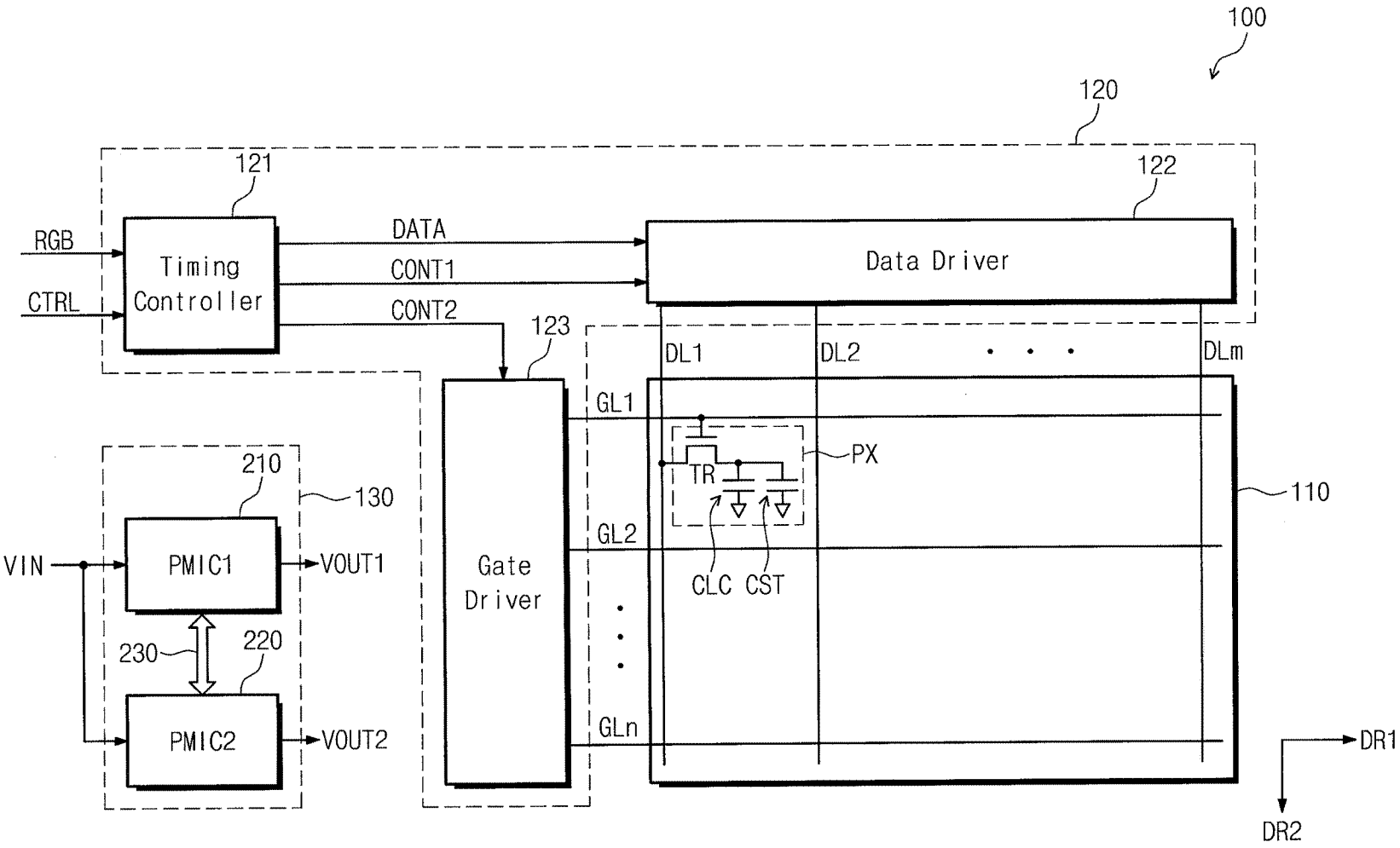
FIG. 1 is a block diagram illustrating a configuration of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a configuration of a display device according to an embodiment of the inventive concept.

Referring to FIG. 1, a display device 100 includes a display panel 110, a drive circuit 120, and a voltage generating circuit 130.

The display panel 110 includes a plurality of data lines DL1 to DLm, a plurality of gate lines GL1 to GLn crossing the plurality of data lines DL1 to DLm, and a plurality of pixels PX at crossing regions of the plurality of data lines DL1 to DLm and the plurality of gate lines GL1 to GLn. The plurality of gate lines GL1 to GLn extend in a first direction DR1 from a gate driver 123, and are sequentially arranged with each other in a second direction DR2. The plurality of data lines DL1 to DLm extend in the first direction DR1 from a data driver 122, and are sequentially arranged with each other in the first direction DR1. The plurality of data lines DL1 to DLm and the plurality of gate lines GL1 to GLn are insulated from each other.

Each pixel PX may include a switching transistor TR connected to a corresponding data line and a corresponding gate line, a liquid crystal capacitor CLC connected to the switching transistor TR, and a storage capacitor CST.

The drive circuit 120 includes a timing controller 121, the data driver 122, and the gate driver 123. The timing controller 121 receives an image signal RGB and a control signal CTRL from the outside (e.g., external to the drive circuit 120 or the display device 100). The timing controller 121 provides a data signal DATA and a first control signal CONT1 to the data driver 122, and provides a second control signal CONT2 to the gate driver 123. The first control signal CONT1 may include a clock signal, a polarity control signal, and a load signal.

The data driver 122 drives the plurality of data lines DL1 to DLm in response to the data signal DATA and the first control signal CONT1 from the timing controller 121. The data driver 122 may be implemented as a separated integrated circuit that may be electrically connected to one side of the display panel 110 or may be directly mounted on the display panel 110. Additionally, the data driver 122 may be implemented as a single chip or may include a plurality of chips.

The gate driver 123 drives the gate lines GL1 to GLn in response to the second control signal CONT2 from the timing controller 121. The second control signal CONT2 may include a start signal STV and a clock signal. The gate driver 123 may be implemented as a separate integrated chip and may be electrically connected to one side of the display panel 110. Additionally, the gate driver 123 may be implemented with an amorphous silicon gate (ASG) using an amorphous Silicon Thin Film Transistor (a-Si TFT) or a circuit using an oxide semiconductor, a crystalline semiconductor, or a polycrystalline semiconductor, and may be integrated at an area (e.g., a predetermined area) of the display panel 110. According to another embodiment of the inventive concept, the gate driver 123 may be implemented with a tape carrier package (TCP) or a chip on film (COF).

While a gate on voltage is applied to a gate line, a switching transistor TR of each pixel in a row connected thereto is turned on. The data driver 122 provides data driving signals corresponding to the data signal DATA to the data lines DL1 to DLm. The data driving signals supplied to the data lines DL1 to DLm are applied to a corresponding pixel through the turned-on switching transistor TR.

The voltage generating circuit 130 converts an input voltage VIN to output voltages VOUT1 and VOUT2. The output voltages VOUT1 and VOUT2 outputted from the voltage generating circuit 130 are voltages used for operations of the display panel 110, the data driver 122, and/or the gate driver 123. For example, the output voltages VOUT1 and VOUT2 may be analog power voltages used for an operation of the data driver 122, a common voltage to be applied to the display panel 110, and/or a gate on voltage used for an operation of the gate driver 123. The voltage generating circuit 130 may further generate various voltages in addition to the output voltages VOUT1 and VOUT2.

The voltage generating circuit 130 includes a first voltage generator 210 and a second voltage generator 220. The first voltage generator 210 outputs a first output voltage VOUT1, and the second voltage generator 220 outputs a second output voltage VOUT2. Each of the first voltage generator 210 and the second voltage generator 220 may be implemented with a power management integrated circuit (PMIC). The first voltage generator 210 and the second voltage generator 220 may be connected to each other through a serial interface bus 230. When each of the first voltage generator 210 and the second voltage generator 220 is implemented with a PMIC, the serial interface bus 230 may be an Inter-Integrated Circuit (I2C).

Figure 2:
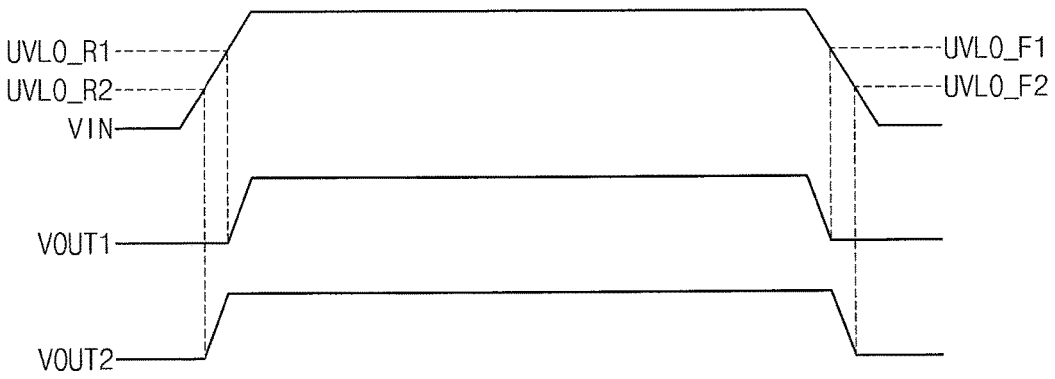
FIG. 2 is a view illustrating an operation of a voltage generating circuit shown in FIG. 1.

FIG. 2 is a view illustrating an operation of a voltage generating circuit shown in FIG. 1.

Referring to FIGS. 1 and 2, each of the first voltage generator 210 and the second voltage generator 220 includes an under voltage lock out (UVLO) function. That is, after powering on, when the input voltage VIN reaches a rising reference voltage level (e.g., a predetermined rising reference voltage level), the first voltage generator 210 and the second voltage generator 220 convert the input voltage VIN into the first output voltage VOUT1 and the second output voltage VOUT2 and output the first output voltage VOUT1 and the second output voltage VOUT2, respectively. Additionally, when the input voltage VIN reaches a falling reference voltage level during an operating state, the first voltage generator 210 and the second voltage generator 220 stop outputting the first output voltage VOUT1 and the second output voltage VOUT2, respectively. That is, when the input voltage VIN is inputted at a stable or substantially stable level, a stable operation of the display device 100 may be maintained or substantially maintained by outputting the first output voltage VOUT1 and the second output voltage VOUT2.

As shown in FIG. 2, a first rising reference voltage UVLO_R1 of the first voltage generator 210 and a second rising reference voltage UVLO_R2 of the second voltage generator 220 may be different from each other. When the first rising reference voltage UVLO_R1 and the second rising reference voltage UVLO_R2 are different from each other, a time point when the first voltage generator 210 starts to output the first output voltage VOUT1 and a time point when the second voltage generator 220 starts to output the second output voltage VOUT2 may be different from each other.

Similarly, a first falling reference voltage UVLO_F1 of the first voltage generator 210 and a second falling reference voltage UVLO_F2 of the second voltage generator 220 may be different from each other. When the first falling reference voltage UVLO_F1 and the second falling reference voltage UVLO_F2 are different from each other, a time point when the first voltage generator 210 stops outputting the first output voltage VOUT1 and a time point when the second voltage generator 220 stops outputting the second output voltage VOUT2 may be different from each other. When one of the first output voltage VOUT1 and the second output voltage VOUT2 is outputted, errors may occur from an image displayed on a display panel.

For example, if the first voltage generator 210 and the second voltage generator 220 provided in the voltage generating circuit 130 do not have the same type (e.g., kind) of ICs, the first rising reference voltage UVLO_R1 and the second rising reference voltage UVLO_R2 may not correspond to each other, and the first falling reference voltage UVLO_F1 and the second falling reference voltage UVLO_F2 may not correspond to each other.

Figure 3:
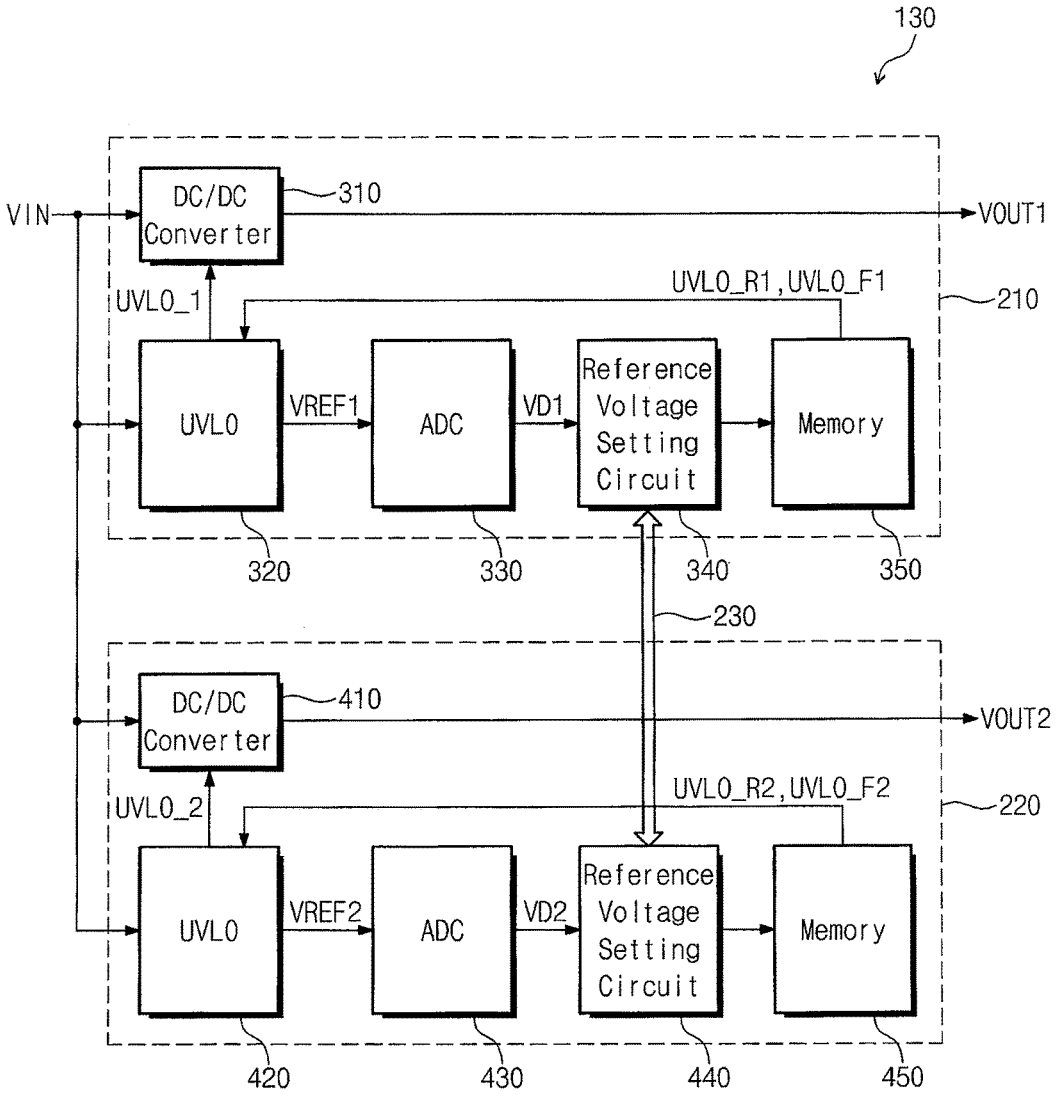
FIG. 3 is a view illustrating a configuration of a voltage generating circuit shown in FIG. 1.

FIG. 3 is a view illustrating a configuration of a voltage generating circuit shown in FIG. 1.

Referring to FIG. 3, the voltage generating circuit 130 includes a first voltage generator 210 and a second voltage generator 220. The first voltage generator 210 includes a DC/DC converter 310, a UVLO unit 320, an analog to digital converter (ADC) 330, a reference voltage setting circuit 340, and a memory 350.

The DC/DC converter 310 receives an input voltage VIN, and outputs a first output voltage VOUT1 in response to a first low voltage control signal UVLO_1. The UVLO unit 320 compares a voltage level of the input voltage VIN with a first reference voltage VREF1, and outputs the first reference voltage VREF1 and the first low voltage control signal UVLO_1.

The analog to digital converter 330 converts the first reference voltage VREF1 into first reference voltage data VD1. The reference voltage setting circuit 340 transmits the first reference voltage data VD1 to the second voltage generator 220 through the serial interface bus 230, and receives second reference voltage data VD2 from the second voltage generator 220. The reference voltage setting circuit 340 compares the first reference voltage data VD1 and the second reference voltage data VD2, and selectively changes the first rising reference voltage UVLO_R1 and the first falling reference voltage UVLO_F1 stored in the memory 350, according to a comparison result. The first rising reference voltage UVLO_R1 and the first falling reference voltage UVLO_F1 stored in the memory 350 are provided to the UVLO unit 320. The first rising reference voltage UVLO_R1 and the first falling reference voltage UVLO_F1 stored in the memory 350 may be digital signals corresponding to respective voltage levels.

The second voltage generator 220 includes a DC/DC converter 410, a UVLO unit 420, an analog to digital converter (ADC) 430, a reference voltage setting circuit 440, and a memory 450.

The DC/DC converter 410 receives an input voltage VIN, and outputs a second output voltage VOUT2 in response to a second low voltage control signal UVLO_2. The UVLO unit 420 compares a voltage level of the input voltage VIN with a second reference voltage VREF2, and outputs the second reference voltage VREF2 and the second low voltage control signal UVLO_2.

The analog to digital converter 430 converts the second reference voltage VREF2 into the second reference voltage data VD2. The reference voltage setting circuit 440 transmits the second reference voltage data VD2 to the first voltage generator 210 through the serial interface bus 230, and receives the first reference voltage data VD1 from the first voltage generator 210. The reference voltage setting circuit 440 compares the first reference voltage data VD1 and the second reference voltage data VD2, and selectively changes the second rising reference voltage UVLO_R2 and the second falling reference voltage UVLO_F2 stored in the memory 450, according to a comparison result. The second rising reference voltage UVLO_R2 and the second falling reference voltage UVLO_F2 stored in the memory 450 are provided to the UVLO unit 420. The second rising reference voltage UVLO_R2 and the second falling reference voltage UVLO_F2 stored in the memory 450 may be digital signals corresponding to respective voltage levels.

Figure 4:
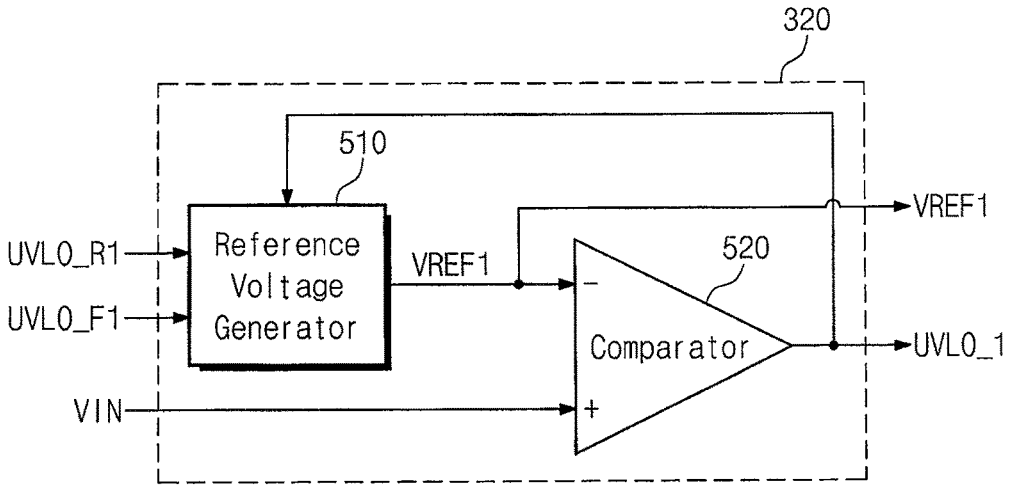
FIG. 4 is a view illustrating a configuration of a UVLO unit in a first voltage generator shown in FIG. 3.

FIG. 4 is a view illustrating a configuration of the UVLO unit in the first voltage generator shown in FIG. 3. The UVLO unit in the second voltage generator shown in FIG. 3 has the same or substantially the same configuration as that of the UVLO unit in the first voltage generator shown in FIG. 4, and thus, description thereof will not be repeated.

Referring to FIGS. 3 and 4, the UVLO unit 320 includes a reference voltage generator 510 and a comparator 520. The reference voltage generator 510 generates a first reference voltage VREF1 corresponding to one of the first rising reference voltage UVLO_R1 and the first falling reference voltage UVLO_F1, which are provided from the memory 350, in response to a first low voltage control signal UVLO_1. The first reference voltage VREF1 may be provided to the analog to digital converter (ADC) 330 shown in FIG. 3.

The comparator 520 compares the input voltage VIN and the first reference voltage VREF1, and outputs the first low voltage control signal UVLO_1 according to a comparison result. The first low voltage control signal UVLO_1 is provided to the DC/DC converter 310 shown in FIG. 3.

An operation of the UVLO unit 320 having such a configuration is as follows. After a power off state changes to a power on stage, the reference voltage generator 510 outputs a first reference voltage VREF1 corresponding to a first rising reference voltage UVLO_R1 set by default.

After powering on, when a voltage level of the input voltage VIN is less than the first reference voltage VREF1, the comparator 520 outputs a low level of a first low voltage control signal UVLO_1. The DC/DC converter 310 does not output a first output voltage VOUT1 while the first low voltage control signal UVLO_1 has the low level.

While the first low voltage control signal UVLO_1 has the low level, the reference voltage generator 510 outputs a first reference voltage VREF1 corresponding to the first rising reference voltage UVLO_R1.

When a voltage level of the input voltage VIN is higher than the first reference voltage VREF1, the comparator 520 outputs a high level of a first low voltage control signal UVLO_1. The DC/DC converter 310 outputs the first output voltage VOUT1 while the first low voltage control signal UVLO_1 has the high level.

When the first low voltage control signal UVLO_1 transitions to the high level, the reference voltage generator 510 outputs a first reference voltage VREF1 corresponding to the first falling reference voltage UVLO_F1, from the memory 350.

When a voltage level of the input voltage VIN is lower than the first reference voltage VREF1 corresponding to the first falling reference voltage UVLO_F1, the comparator 520 outputs a low level of a first low voltage control signal UVLO_1. In such a way, the UVLO unit 320 may control a voltage generating operation of the DC/DC converter 310 by comparing the input voltage VIN and the first reference voltage VREF1.

Again, referring to FIG. 3, if the first reference voltage VREF1 of the UVLO unit 320 in the first voltage generator 210 is the same or substantially the same as the second reference voltage VREF2 of the UVLO unit 420 in the second voltage generator 220, the transition timings of the first low voltage control signal UVLO_1 and the second low voltage control signal UVLO_2 may be the same or substantially the same. However, if the first reference voltage VREF1 of the UVLO unit 320 is different from the second reference voltage VREF2 of the UVLO unit 420 due to manufacturing variations, the transition timings of the first low voltage control signal UVLO_1 and the second low voltage control signal UVLO_2 may be different from each other.

Figure 5:
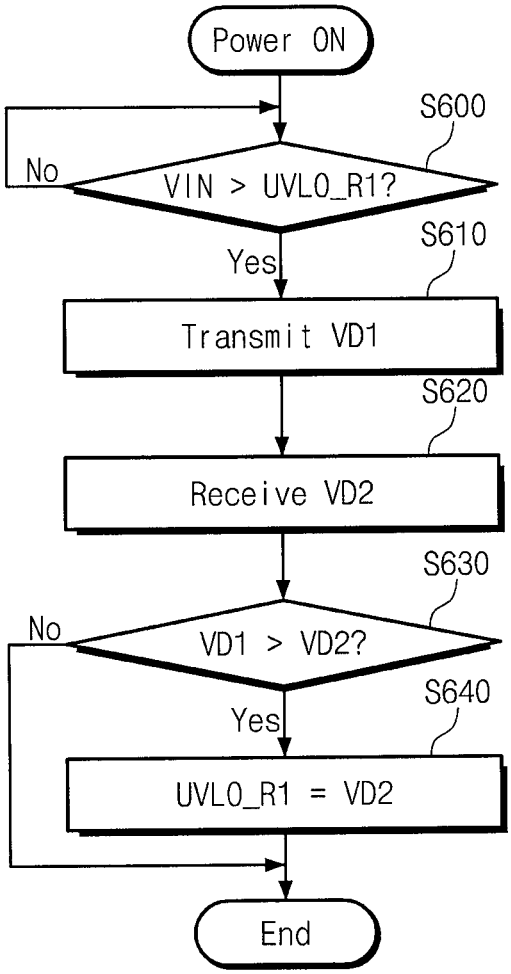
FIG. 5 is a flowchart illustrating an operation of a first voltage generator shown in FIG. 3.

FIG. 5 is a flowchart illustrating an operation of a first voltage generator shown in FIG. 3.

Referring to FIGS. 3 and 5, when power is on, the UVLO unit 320 compares the input voltage VIN with the first rising reference voltage UVLO_R1 in operation S600. When a voltage level of the input voltage VIN is higher than the first rising reference voltage UVLO_R1, the UVLO unit 320 outputs a high level of the first low voltage control signal UVLO_1. While the first low voltage control signal UVLO_1 is at the high level, the DC/DC converter 310 outputs the first output voltage VOUT1.

The analog to digital converter (ADC) 330 converts the first reference voltage VREF1 into the first reference voltage data VD1. The reference voltage setting circuit 340 transmits the first reference voltage data VD1 corresponding to the first reference voltage VREF1 to the second voltage generator 220 through the serial interface bus 230 in operation S610. The reference voltage setting circuit 340 receives the second reference voltage data VD2 corresponding to the second reference voltage VREF2 from the second voltage generator 220 in operation S620.

The reference voltage setting circuit 340 compares the first reference voltage data VD1 corresponding to the first reference voltage VREF1 and the second reference voltage data VD2 corresponding to the second reference voltage VREF2 in operation S630.

When the first reference voltage data VD1 corresponding to the first reference voltage VREF1 is greater than the second reference voltage data VD2 corresponding to the second reference voltage VREF2, the reference voltage setting circuit 340 changes the first rising reference voltage UVLO_R1 stored in the memory 350 into the second reference voltage data VD2 corresponding to the second reference voltage VREF2 in operation S640.

Figure 6:
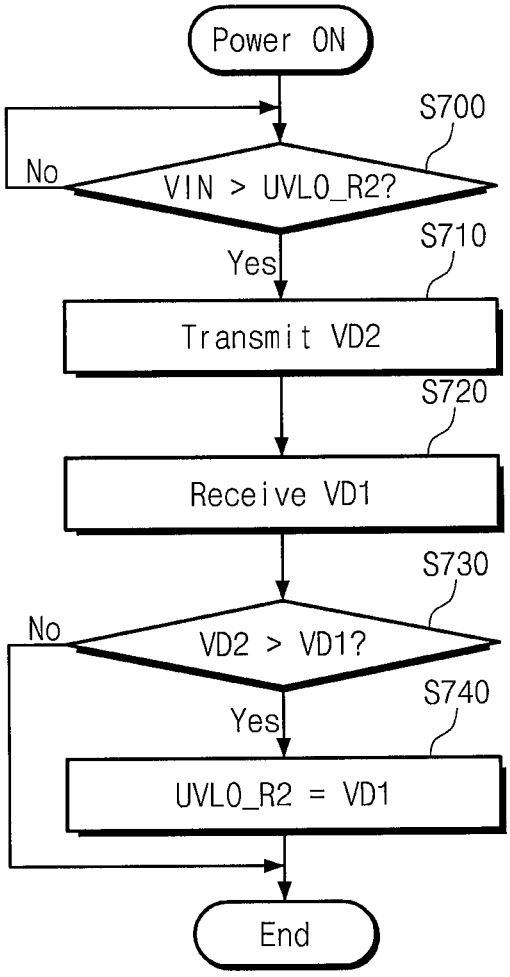
FIG. 6 is a flowchart illustrating an operation of a second voltage generator shown in FIG. 3.

FIG. 6 is a flowchart illustrating an operation of a second voltage generator shown in FIG. 3.

Referring to FIGS. 3 and 6, when power is on, the UVLO unit 420 compares the input voltage VIN with the second rising reference voltage UVLO_R2 in operation S700. When a voltage level of the input voltage VIN is higher than the second rising reference voltage UVLO_R2, the UVLO unit 420 outputs a high level of the second low voltage control signal UVLO_2. While the second low voltage control signal UVLO_2 is at the high level, the DC/DC converter 410 outputs the second output voltage VOUT2.

The analog to digital converter 430 converts the second reference voltage VREF2 into the second reference voltage data VD2. The reference voltage setting circuit 440 transmits the second reference voltage data VD2 corresponding to the second reference voltage VREF2 to the first voltage generator 210 through the serial interface bus 230 in operation S710. The reference voltage setting circuit 440 receives the first reference voltage data VD1 corresponding to the first reference voltage VREF1 from the first voltage generator 210 through the serial interface bus 230 in operation S720.

The reference voltage setting circuit 440 compares the second reference voltage data VD2 corresponding to the second reference voltage VREF2 and the first reference voltage data VD1 corresponding to the first reference voltage VREF1 in operation S730.

When the second reference voltage data VD2 corresponding to the second reference voltage VREF2 is greater than the first reference voltage data VD1 corresponding to the first reference voltage VREF1, the reference voltage setting circuit 440 changes the second rising reference voltage UVLO_R2 stored in the memory 450 into the first reference voltage data VD1 corresponding to the first reference voltage VREF1 in operation S740.

Through the operating method shown in FIGS. 3, 5, and 6, one of the first reference voltage data VD1 and the second reference voltage data VD2 corresponding to a lower voltage from among the first reference voltage VREF1 and the second reference voltage VREF2 is stored, as either the first rising reference voltage UVLO_R1 or the second rising reference voltage UVLO_R2, in either the memory 350 in the first voltage generator 210 or the memory 450 in the second voltage generator 220. Therefore, the first rising reference voltage UVLO_R1 of the first voltage generator 210 and the second rising reference voltage UVLO_R2 of the second voltage generator 220 may be set to the same or substantially the same level.

Figure 7:
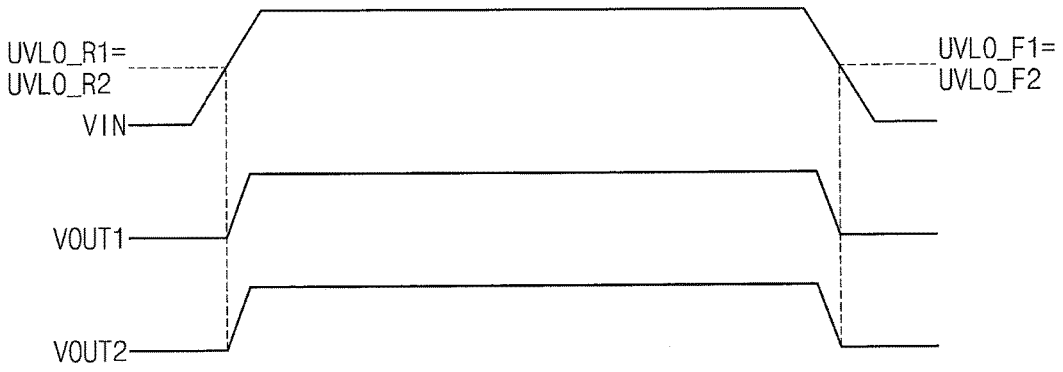
FIG. 7 is a view illustrating a first output voltage and a second output voltage, which are generated from a voltage generating circuit shown in FIG. 3.

FIG. 7 is a view illustrating a first output voltage and a second output voltage, which are generated from a voltage generating circuit shown in FIG. 3.

Referring to FIGS. 3 and 7, in relation to the voltage generating circuit 130, the first rising reference voltage UVLO_R1 of the first voltage generator 210 and the second rising reference voltage UVLO_R2 of the second voltage generator 220 may be set to the same or substantially the same level. After power is turned on, when the input voltage VIN reaches the first rising reference voltage UVLO_R1 and the second rising reference voltage UVLO_R2, the first voltage generator 210 and the second voltage generator 220 may output the first output voltage VOUT1 and the second output voltage VOUT2, respectively. Therefore, time points for outputting the first output voltage VOUT1 and the second output voltage VOUT2 may become the same or substantially the same.

Figure 8:
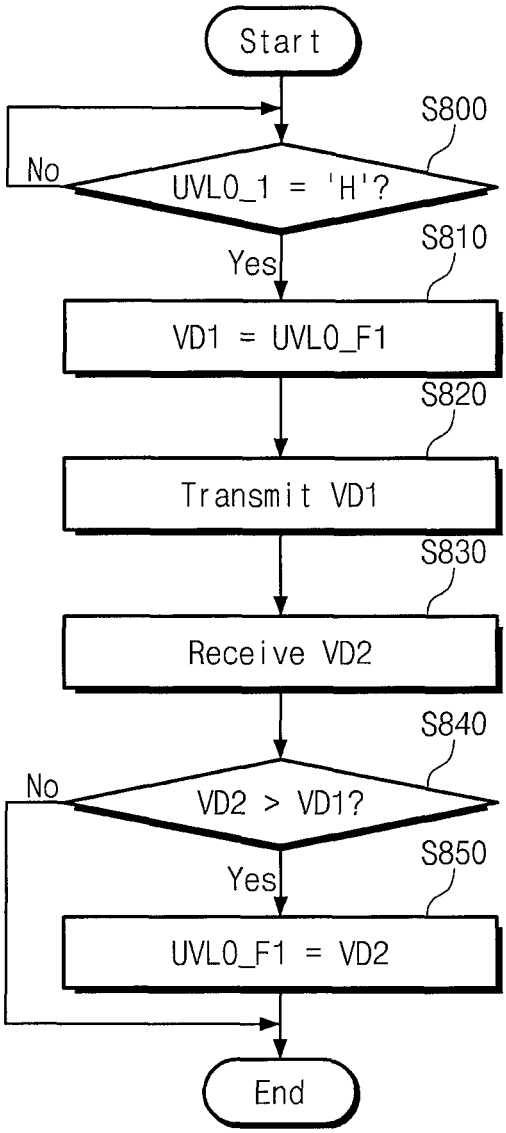
FIG. 8 is a flowchart illustrating an operation of a first voltage generator shown in FIG. 3.

FIG. 8 is a flowchart illustrating an operation of a first voltage generator shown in FIG. 3.

Referring to FIGS. 3, 4, and 8, the UVLO unit 320 in the first voltage generator 320 determines whether the first low voltage control signal UVLO_1 is at a high level H in operation S800. When the first low voltage control signal UVLO_1 is in the high level H, the UVLO unit 320 outputs the first reference voltage VREF1 corresponding to (e.g., equal to) the first falling reference voltage UVLO_F1 in operation S810.

The analog to digital converter (ADC) 330 converts the first reference voltage VREF1 into the first reference voltage data VD1. The reference voltage setting circuit 340 transmits the first reference voltage data VD1 corresponding to the first reference voltage VREF1 to the second voltage generator 220 through the serial interface bus 230 in operation S820. The reference voltage setting circuit 340 receives the second reference voltage data VD2 corresponding to the second reference voltage VREF2 from the second voltage generator 220 in operation S830.

The reference voltage setting circuit 340 compares the first reference voltage data VD1 corresponding to the first reference voltage VREF1 and the second reference voltage data VD2 corresponding to the second reference voltage VREF2 in operation S840.

When the second reference voltage data VD2 corresponding to the second reference voltage VREF2 is greater than the first reference voltage data VD1 corresponding to the first reference voltage VREF1, the reference voltage setting circuit 340 changes the first falling reference voltage UVLO_F1 stored in the memory 350 into the second reference voltage data VD2 corresponding to the second reference voltage VREF2 in operation S850.

Figure 9:
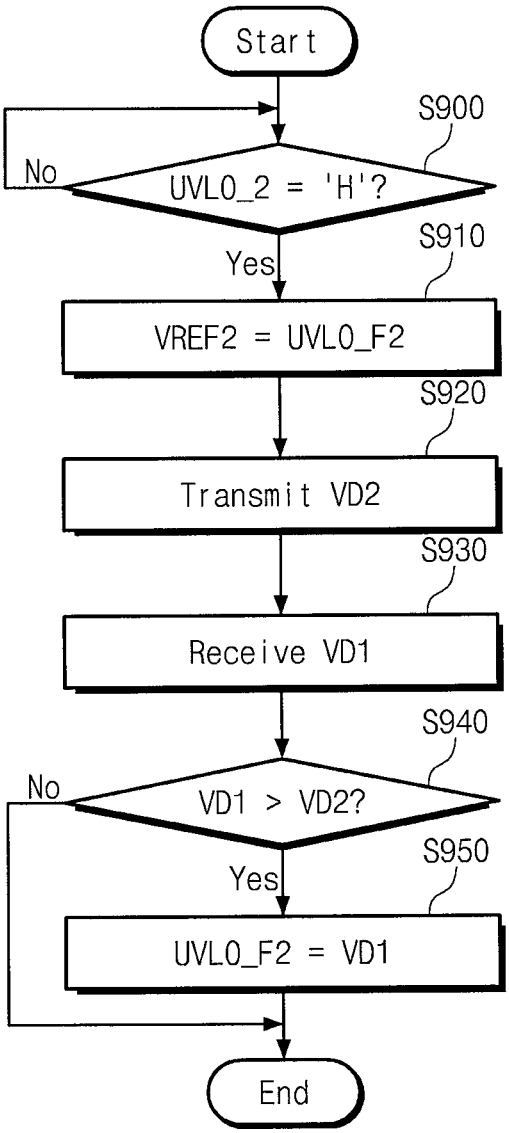
FIG. 9 is a flowchart illustrating an operation of a second voltage generator shown in FIG. 3.

FIG. 9 is a flowchart illustrating an operation of a second voltage generator shown in FIG. 3.

Referring to FIGS. 3 and 9, the UVLO unit 420 in the second voltage generator 220 determines whether the second low voltage control signal UVLO_2 is at a high level H in operation S900. When the second low voltage control signal UVLO_2 is at the high level H, the UVLO unit 420 outputs the second reference voltage VREF2 corresponding to the second falling reference voltage UVLO_F2 in operation S910.

The analog to digital converter 430 converts the second reference voltage VREF2 into the second reference voltage data VD2. The reference voltage setting circuit 440 transmits the second reference voltage data VD2 corresponding to the second reference voltage VREF2 to the first voltage generator 210 through the serial interface bus 230 in operation S920. The reference voltage setting circuit 440 receives the first reference voltage data VD1 corresponding to the first reference voltage VREF1 from the first voltage generator 210 through the serial interface bus 230 in operation S930.

The reference voltage setting circuit 440 compares the second reference voltage data VD2 corresponding to the second reference voltage VREF2 and the first reference voltage data VD1 corresponding to the first reference voltage VREF1 in operation S940.

When the first reference voltage data VD1 corresponding to the first reference voltage VREF1 is greater than the second reference voltage data VD2 corresponding to the second reference voltage VREF2, the reference voltage setting circuit 440 changes the second falling reference voltage UVLO_F2 stored in the memory 450 into the first reference voltage data VD1 corresponding to the first reference voltage VREF1 in operation S950.

Through the operating method shown in FIGS. 3, 8, and 9, one of the first reference voltage data VD1 and the second reference voltage data VD2 corresponding to a higher voltage from among the first reference voltage VREF1 and the second reference voltage VREF2 is stored, as either the first falling reference voltage UVLO_F1 or the second falling reference voltage UVLO_F2, in either the memory 350 in the first voltage generator 210 or the memory 450 in the second voltage generator 220. Therefore, the first falling reference voltage UVLO_F1 of the first voltage generator 210 and the second falling reference voltage UVLO_F2 of the second voltage generator 220 may be set to the same or substantially the same level.

Again, referring to FIGS. 3 and 7, in relation to the voltage generating circuit 130, the first falling reference voltage UVLO_F1 of the first voltage generator 210 and the second falling reference voltage UVLO_F2 of the second voltage generator 220 may be set to the same or substantially the same level. In a normal operation state of the display device 100, after power is turned on, when the input voltage VIN drops to a voltage lower than the first falling reference voltage UVLO_F1 and the second falling reference voltage UVLO_F2, the first voltage generator 210 and the second voltage generator 220 may stop outputting the first output voltage VOUT1 and the second output voltage VOUT2, respectively. Because the first falling reference voltage UVLO_F1 and the second falling reference voltage UVLO_F2 are the same or substantially the same, time points when the outputs of the first output voltage VOUT1 and the second output voltage VOUT2 are stopped may be the same or substantially the same.

A voltage generating circuit having such a configuration may output a stable or substantially stable voltage by detecting a voltage level of an input voltage. When a voltage generating circuit includes a plurality of integrated circuits, malfunctions of the voltage generating circuit may be prevented or reduced by matching reference voltages in the plurality of integrated circuits.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is understood that the present invention should not be limited to these exemplary embodiments, and that various changes and modifications may be made by one having ordinary skilled in the art without departing from the spirit and scope of the present invention as defined in the following claims and their equivalents.

What is claimed is:

1. A voltage generating circuit comprising:

a first output voltage generator configured to receive an input voltage, to output a first output voltage, to compare the input voltage with a first reference voltage, and to stop the output of the first output voltage according to the comparison; and a second output voltage generator configured to receive the input voltage, to output a second output voltage, to compare the input voltage with a second reference voltage, and to stop the output of the second output voltage according to the comparison, wherein:

the first output voltage generator is configured to convert the first reference voltage to first reference voltage data and to provide the first reference voltage data to the second output voltage generator, and the second output voltage generator is configured to convert the second reference voltage to second reference voltage data and to provide the second reference voltage data to the first output voltage generator;

the first output voltage generator is configured to compare the first reference voltage data with the second reference voltage data, and to change the first reference voltage according to the comparison; and the second output voltage generator is configured to compare the first reference voltage data with the second reference voltage data, and to change the second reference voltage according to the comparison.

2. The voltage generating circuit of claim 1, wherein the first output voltage generator is configured to transmit the first reference voltage data and receive the second reference voltage data through a serial interface bus, and the second output voltage generator is configured to transmit the second reference voltage data and receive the first reference voltage data through the serial interface bus.

3. The voltage generating circuit of claim 1, wherein the first output voltage generator comprises:

a first output voltage converter configured to receive the input voltage and to output the first output voltage;

a first controller configured to compare the input voltage with the first reference voltage, and to stop the output of the first output voltage according to the comparison; and a first comparator configured to compare the first reference voltage data with the second reference voltage data, and to change the first reference voltage according to the comparison.

4. The voltage generating circuit of claim 3, wherein the first comparator comprises:

a first analog to digital converter configured to convert the first reference voltage to the first reference voltage data; and a first reference voltage setting circuit configured to compare the first reference voltage data with second reference voltage data from the second output voltage generator, and to set the first reference voltage data according to the comparison.

5. The voltage generating circuit of claim 4, wherein the first output voltage generator further comprises a first memory configured to store the first reference voltage data.

6. The voltage generating circuit of claim 5, wherein the first controller comprises:

a reference voltage generator configured to generate the first reference voltage based on the first reference voltage data; and a comparator configured to compare the input voltage with the first reference voltage, and to output a low voltage control signal according to the comparison.

7. The voltage generating circuit of claim 6, wherein the first reference voltage to be stored in the first memory comprises a first rising reference voltage and a first falling reference voltage.

8. The voltage generating circuit of claim 7, wherein the reference voltage generator is configured to generate the first reference voltage corresponding to one of the first rising reference voltage and the first falling reference voltage according to a signal level of the low voltage control signal.

9. The voltage generating circuit of claim 4, wherein the second output voltage generator comprises:

a second output voltage converter configured to receive the input voltage and to output the second output voltage;

a second controller configured to compare the input voltage with the second reference voltage, and to stop the output of the second output voltage according to the comparison; and a second comparator configured to compare the second reference voltage data with the first reference voltage data, and to change the second reference voltage according to the comparison.

10. The voltage generating circuit of claim 9, wherein the second comparator comprises:

a second analog to digital converter configured to convert the second reference voltage to the second reference voltage data; and a second reference voltage setting circuit configured to compare the second reference voltage data with the first reference voltage data from the first output voltage generator, and to set the second reference voltage data according to the comparison.

11. The voltage generating circuit of claim 10, wherein the first reference voltage setting circuit is configured to transmit the first reference voltage data and receive the second reference voltage data through a serial interface bus, and the second reference voltage setting circuit is configured to transmit the second reference voltage data and receive the first reference voltage data through the serial interface bus.

12. The voltage generating circuit of claim 1, wherein each of the first output voltage generator and the second output voltage generator is configured with an integrated circuit.

13. A method of operating a voltage generating circuit comprising a first output voltage generator for outputting a first output voltage and a second output voltage generator for outputting a second output voltage, the method comprising:

comparing, by the first output voltage generator, an input voltage with a first reference voltage when the input voltage is supplied;

comparing, by the second output voltage generator, the input voltage with a second reference voltage when the input voltage is supplied;

converting, by the first output voltage generator, the first reference voltage to first reference voltage data;

converting, by the second output voltage generator, the second reference voltage to second reference voltage data;

comparing, by the first output voltage generator, the first reference voltage data with the second reference voltage data when the input voltage has a higher level than that of the first reference voltage;

changing the first reference voltage of the first output voltage generator according to the comparison of the first reference voltage data with the second reference voltage data;

comparing, by the second output voltage generator, the first reference voltage data with the second reference voltage data when the input voltage has a higher level than that of the second reference voltage; and changing the second reference voltage of the second output voltage generator according to the comparison of the first reference voltage data with the second reference voltage data.

14. The method of claim 13, wherein the first reference voltage comprises a first rising reference voltage, and the second reference voltage comprises a second rising reference voltage.

15. The method of claim 14, wherein the first reference voltage further comprises a first falling reference voltage, and the second reference voltage further comprises a second falling reference voltage.

16. The method of claim 15, further comprising:

comparing, by the first output voltage generator, the first falling reference voltage with the second falling reference voltage;

changing the first falling reference voltage of the first output voltage generator according to the comparison of the first falling reference voltage with the second falling reference voltage;

comparing, by the second output voltage generator, the first falling reference voltage with the second falling reference voltage; and changing the second falling reference voltage of the second output voltage generator according to the comparison of the first falling reference voltage with the second falling reference voltage.

17. A display device comprising:

a display panel;

a drive circuit configured to display an image on the display panel; and a voltage generating circuit configured to generate a first output voltage and a second output voltage for operation of the display panel and/or the drive circuit, wherein the voltage generating circuit comprises:

a first output voltage generator configured to receive an input voltage, to output a first output voltage, to compare the input voltage with a first reference voltage, and to stop the output of the first output voltage according to a the comparison; and a second output voltage generator configured to receive the input voltage, to output a second output voltage, to compare the input voltage with a second reference voltage, and to stop the output of the second output voltage according to the comparison, and wherein:

the first output voltage generator is configured to convert the first reference voltage to first reference voltage data and to provide the first reference voltage data to the second output voltage generator, and the second output voltage generator is configured to convert the second reference voltage to second reference voltage data and to provide the second reference voltage data to the first output voltage generator;

the first output voltage generator is configured to compare the first reference voltage data with the second reference voltage data, and to change the first reference voltage according to the comparison; and the second output voltage generator is configured to compare the first reference voltage data with the second reference voltage data, and to change the second reference voltage according to the comparison.

18. The display device of claim 17, wherein the first output voltage generator is configured to transmit the first reference voltage data and receive the second reference voltage data through a serial interface bus, and the second output voltage generator is configured to transmit the second reference voltage data and receive the first reference voltage data through the serial interface bus.

19. The display device of claim 17, wherein each of the first output voltage generator and the second output voltage generator is configured with an integrated circuit.

* * * * *